US007407149B1

(12) United States Patent
Zindell

(10) Patent No.: US 7,407,149 B1
(45) Date of Patent: Aug. 5, 2008

(54) WINCH UNIT

(76) Inventor: Jan E. Zindell, P.O. Box 1144, Hermiston, OR (US) 97838-3144

( * ) Notice: Subject to any disclaimer, the term of this patent is extended or adjusted under 35 U.S.C. 154(b) by 0 days.

(21) Appl. No.: 11/810,103

(22) Filed: Jun. 4, 2007

(51) Int. Cl.
*B66D 1/00* (2006.01)

(52) U.S. Cl. ..... 254/323; 254/325; 414/538

(58) Field of Classification Search ..... 254/323, 254/325; 414/537, 538
See application file for complete search history.

(56) References Cited

U.S. PATENT DOCUMENTS 3,843,002 A * 10/1974 Pihlgren ..... 414/462
4,050,587 A * 9/1977 Moen ..... 212/301
4,084,713 A 4/1978 Rohrs
4,155,468 A 5/1979 Royce
4,515,510 A * 5/1985 Heward et al. ..... 414/422
4,966,516 A 10/1990 Vartanian
5,199,842 A 4/1993 Watt
5,380,144 A 1/1995 Smith
5,509,639 A * 4/1996 Ellis ..... 254/380
6,293,351 B1 9/2001 Schmidt
6,386,514 B1 5/2002 Ray
6,616,396 B2 * 9/2003 Sternberg ..... 414/538
6,651,960 B1 11/2003 Koester
6,695,565 B1 * 2/2004 Franchuk ..... 414/537
6,698,994 B2 * 3/2004 Barrett ..... 414/462
6,860,471 B2 * 3/2005 Albritton ..... 254/323
6,916,056 B2 * 7/2005 Mitchell et al. ..... 296/20
6,921,095 B2 * 7/2005 Middleby ..... 280/47.29

* cited by examiner

*Primary Examiner*—Emmanuel M Marcelo

(57) ABSTRACT

A unit that includes a winch, a standard for the winch, a platform and a ramp and which can be disassembled for storage and easily and quickly set up to move a device, such as a scooter or a wheelchair or the like, onto another vehicle, such as a van or a car or the like.

1 Claim, 2 Drawing Sheets

WINCH UNIT

TECHNICAL FIELD OF THE INVENTION

The present invention relates to the general art of lifting devices, and to the particular field of winches.

BACKGROUND OF THE INVENTION

Vehicles, such as automobiles, are generally designed in structure to carry objects and people inside the vehicle structure. Objects can be carried in either the passenger compartment or in the baggage section or trunk of the automobile. Additionally, automobiles frequently carry objects externally to the trunk or passenger compartment areas, such as objects which are either too large or are not appropriately structured for being carried in the passenger compartment or trunk.

Numerous type vehicle attachments for the roof top, side, front or rear end both permanently and semi-permanently affixed to the vehicle have been proposed. The structure, alignment and positioning of these carriers have generally been dictated by the exact type of object that the carrier is designed to accommodate. For example, roof top carriers have been designed and structured to carry relatively light objects, such as luggage, boxes and the like which can be fitted easily on the roof top. Carriers structured for the use on the rear of the vehicle are used for many purposes, such as, for example, bicycles, small vehicles, light motorcycles, and similarly irregularly structured objects which do not lend themselves readily to being carried on a vehicle roof or other areas because of their cumbersome shape or weight characteristics.

The transportation of wheelchairs when not in use presents a difficult problem because of their bulky weight and unusual shape. Typically, in order to transport a wheelchair by way of an automobile, it must be ordinarily loaded into the back seat area of the vehicle which is tedious, awkward and time consuming. Additionally, the wheelchair consumes considerable space that could otherwise be used for additional occupants of the automobile. Additionally, there is considerable risk of damage to the upholstery of the interior of the vehicle.

In considering and reviewing the array of all the carriers structured for use on the rear of any vehicle such as automobiles, generally all require that the object to be borne on the carrying platform be physically lifted by an individual's own efforts up and onto the platform itself. Thus, if a person of minimal or limited strength must lift an object which is cumbersome or of substantial weight, it may either be impossible or most difficult to lift the object onto the carrying platform. Indeed, the lifting of any object of any substantial weight or awkward construction by any person may involve a risk of physical injury which may be perilous. Furthermore, most existent carrier devices for the rear end of a vehicle are not readily and completely storable into a compact, unobtrusive device when not it use.

In light of the foregoing state of the art of external vehicle carriers, there is a need for a carrier which is strongly constructed and which will facilitate the lifting of the object onto the carrier; and which carrier can be easily retracted into an unobtrusive and compact storage position when not in use, and thence be readily transformed from this storage position for actual use.

SUMMARY OF THE INVENTION

The above-discussed disadvantages of the prior art are overcome by a unit that includes a winch, a standard for the winch, a platform and a ramp and which can be dissembled for storage and easily and quickly set up to move a device, such as a scooter or a wheelchair or the like, onto another vehicle, such as a van or a car or the like.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Referring to the figures, it can be understood that the present invention is embodied in A vehicle moving unit 10 that is used to move a vehicle, such as a wheelchair or scooter or the like, from one location, such as on the ground, to another location, such as in a van or the like.

Figure 3:
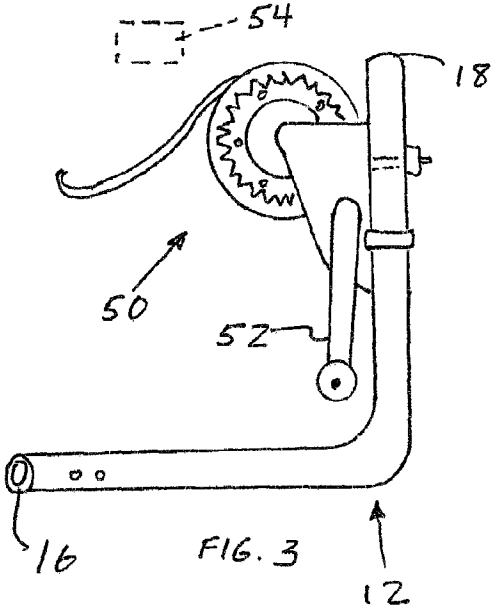
FIG. 3 is a powered winch mounted on the winch tower.
Figure 2:
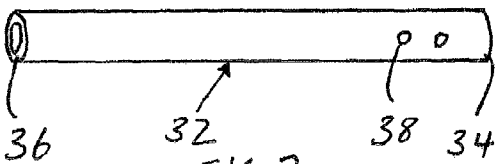
FIG. 2 is a sleeve used in the overall unit.
Figure 1:
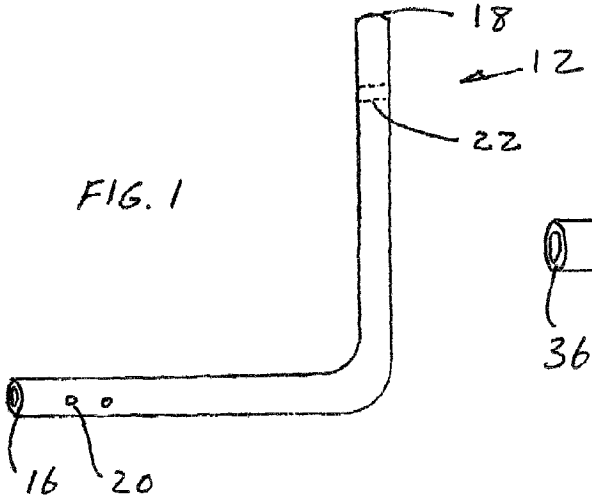
FIG. 1 is a side elevational view of a winch tower element included in the overall unit embodying the present invention.
Figure 4:
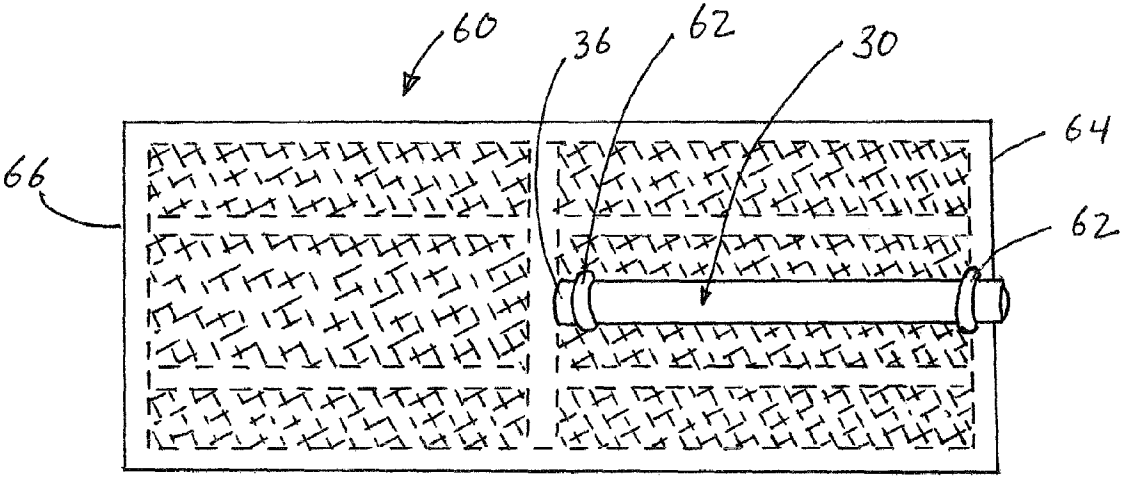
FIG. 4 shows a platform in combination with the sleeve.
Figure 5:
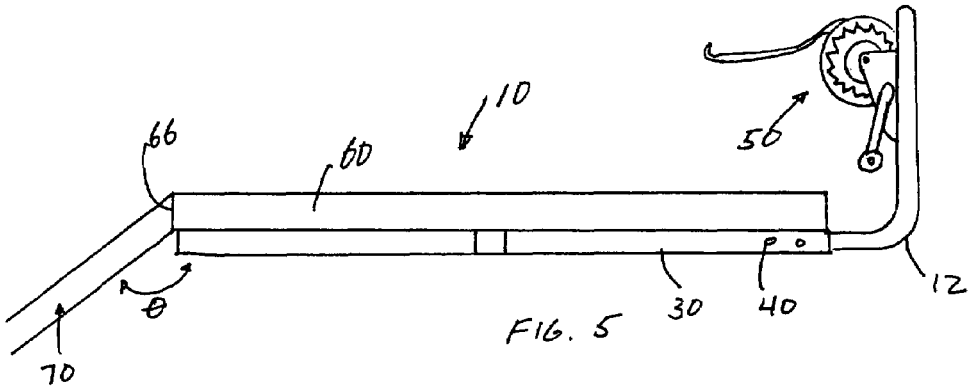
FIG. 5 is a side elevational view of an assembled unit embodying the present invention.
Figure 6:
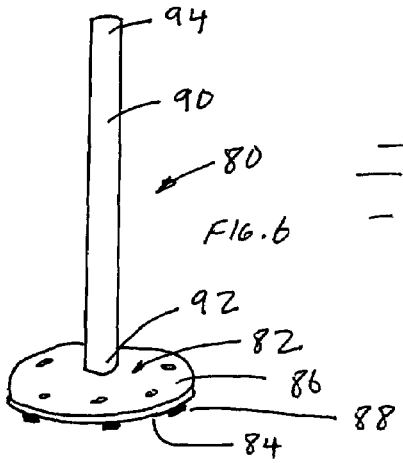
FIG. 6 is a perspective view of an alternative form of the winch tower.
Figure 7:
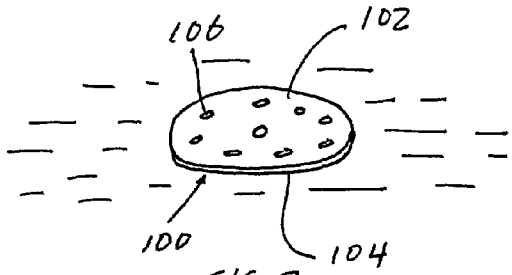
FIG. 7 is a perspective view of a base plate used in conjunction with the alternative form of the winch tower.

Unit 10 comprises a tower unit 12 which includes an L-shaped tube 14 that has a first end 16 which is a bottom end when the tower unit is in use such as shown in FIGS. 1 and 5 and a second end 18 which is a top end when the tower unit is in use. A plurality of fastener-accommodating holes, such as fastener-accommodating hole 20, are defined through the tower unit adjacent to first end 16 thereof. A mounting hole 22 is defined through the tower unit adjacent to second end 18 thereof.

A sleeve element 30 includes a body 32 which has a first end 34 which is sized to slidably attach to first end 16 of the tower unit to couple the sleeve element to the tower unit, and a second end 36. A plurality of fastener-accommodating holes, such as fastener-accommodating hole 38, are defined through the body of the sleeve element adjacent to first end 34 of the sleeve element. A fastener 40 is accommodated in the fastener-accommodating holes of the tower unit and the sleeve element and couples the sleeve element to the tower unit.

A winch unit 50 is mounted on tower unit 12 adjacent to second end 18 of the tower unit. The winch unit is a powered winch unit and includes a handle 52 that is used in the event of a power failure and a power source 54 which can be a battery or the battery of the vehicle being used to transport the chair or scooter. In the case of the battery of the vehicle, the connection between the winch and the vehicle battery can be via the cigarette lighter of the transport vehicle.

Unit 10 further includes a platform element 60 fixedly connected to the sleeve element by bands 62 or the like, and includes a first end 64 located adjacent to the sleeve element. A second end 66 is spaced apart from second end 36 of the sleeve element. A ramp element 70 is fixedly connected to second end 66 of the platform element at an oblique angle θ thereto.

An alternative form of the vehicle moving unit is shown in FIGS. 6-9 as vehicle moving unit 10'. Vehicle moving unit 10' comprises a winch tower 80 which includes a base element 82 which has a first surface 84 that is a bottom surface when the base element is in use and a second surface 86 that is a top surface when the base element is in use. Base element 80 further includes a plurality of lugs, such as lug 88, on first surface 84 of the base element and a post 90 fixedly mounted on the base element. Post 90 includes a first end 92 fixed to the base element and a second end 94 spaced apart from the base element and which is a top end when the winch tower is in use.

Unit 10' further comprises a base plate 100 which includes a first surface 102 that is a top surface when the base plate is in use and a second surface 104 that is a bottom surface when the base plate is in use. A plurality of lug-accommodating slots, such as lug-accommodating slot 106, are defined through the base plate in positions located to accommodate the lugs of the base element of the winch tower to couple the winch tower to the base plate.

Figure 8:
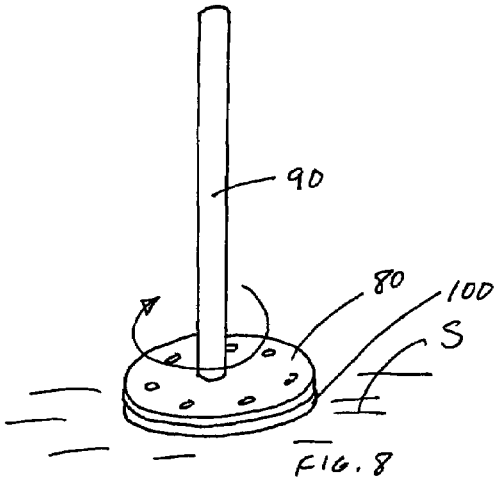
FIG. 8 is a perspective view of the alternative form of the winch tower connected to the base plate shown in FIG. 7.
Figure 9:
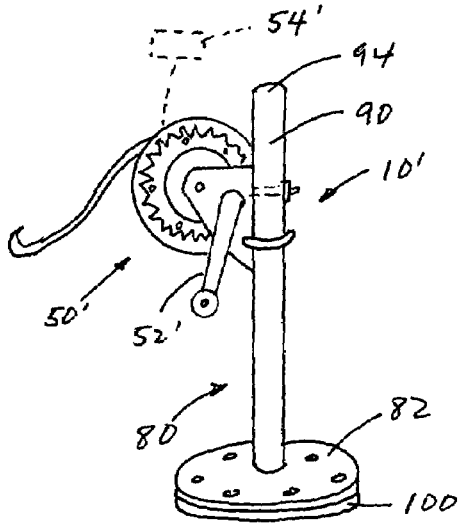
FIG. 9 is shows the alternative form of the unit in the assembled condition.

Base plate 100 is fixedly anchored to a support surface S, such as the floor of a van or the like. As indicated in FIG. 8, lugs 88 are oriented next to associated lug-accommodating slots 106, inserted and turned to couple the base plate to the base element and hence to the support surface. A winch unit 50' is mounted on the winch tower unit adjacent to second end 94 of post 90. Like the above-discussed winch unit 50, winch unit 50' is a powered winch unit and includes a handle 52' which is used in the event of a power failure, and a power source, such as a battery 54'.

It is noted that the platform element and the ramp element described above can also be used in conjunction with the vehicle moving unit shown in FIGS. 6-9 and just described in the manner disclosed above with respect to the unit described in connection with FIGS. 1-5. The platform element would be connected to the base element of unit 10' and the ramp element would be connected to the platform element in the manner described above with respect to FIGS. 1-5.

Both vehicle moving units are used in the same manner. The winch tower is set up on a van or a truck or other such vehicle, the platform element is adjusted to reach the end of the support area of the vehicle, the ramp element is attached to the end of the platform element to extent down to the ground. A vehicle, such as a powered wheelchair, a scooter or the like, is moved onto the platform via the ramp element using the winch which is attached to the vehicle. The vehicle can then be winched into the desired position and location for transport.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A vehicle moving unit comprising:

A) a tower unit which includes an L-shaped tube having
  (1) a first end which is a bottom end when the tower unit is in use,
  (2) a second end which is a top end when the tower unit is in use,
  (3) a plurality of fastener-accommodating holes defined through the tower unit adjacent to the first end of the tower unit, and
  (4) a mounting hole defined through the tower unit adjacent to the second end of the tower unit;

B) a sleeve element which includes
  (1) a body,
  (2) a first end of the body, the first end of the body being sized to slidably attach to the first end of the tower unit to couple the sleeve element to the tower unit,
  (3) a second end, and
  (4) a plurality of fastener-accommodating holes defined through the body of the sleeve element adjacent to the first end of the sleeve element;

C) a fastener accommodated in the fastener-accommodating holes of the tower unit and the sleeve element and coupling the sleeve element to the tower unit;

D) a winch unit mounted on the tower unit adjacent to the second end of the tower unit, the winch unit being a powered winch unit and including
  (1) a handle, and
  (2) a power source;

E) a platform element fixedly connected to the sleeve element and including
  (1) a first end located adjacent to the sleeve element,
  (2) a second end which is spaced apart from the second end of the sleeve element; and F) a ramp element fixedly connected to the second end of the platform element at an oblique angle thereto.

* * * * *